US005729941A

United States Patent [19]

Kassardjian et al.

[11] Patent Number: 5,729,941

[45] Date of Patent: Mar. 24, 1998

[54] PROTECTIVE COVER FOR CONCRETE REINFORCING BAR

[75] Inventors: Vasken Kassardjian, Newport Beach; Patrick Joseph Wilson, Dove Canyon, both of Calif.

[73] Assignee: Don De Cristo Concrete Accessories, Inc., Irvine, Calif.

[21] Appl. No.: 629,549

[22] Filed: Apr. 9, 1996

[51] Int. Cl.[6] ..... E04C 5/16; E04C 5/18

[52] U.S. Cl. ..... 52/301; 52/689; 248/523; 74/558

[58] Field of Search ..... 52/289, 298, 300, 52/301, 689; 138/96 R; 16/121; 74/553; 248/523, 188.9; 135/77

[56] References Cited

U.S. PATENT DOCUMENTS

| | | | |
|---|---|---|---|
| D. 262,093 | 12/1981 | Bush et al. | D8/386 |
| D. 363,657 | 10/1995 | Kassardjian et al. | D8/354 |
| 1,083,120 | 12/1913 | May . | |
| 2,215,251 | 9/1940 | Prince | 138/96 |
| 3,007,726 | 11/1961 | Parkin | 135/77 X |
| 3,199,819 | 8/1965 | Widmark | 135/77 X |
| 3,233,502 | 2/1966 | Fernberg | 85/80 |
| 3,485,271 | 12/1969 | Halsey | 138/96 |
| 3,693,310 | 9/1972 | Middleton | 52/689 |
| 3,890,990 | 6/1975 | Schafer | 135/77 X |
| 4,000,539 | 1/1977 | Neyer | 74/553 |
| 4,012,806 | 3/1977 | Howie, Jr. | 74/553 |
| 4,080,770 | 3/1978 | Vigh | 52/689 |
| 4,119,290 | 10/1978 | Gies | 248/523 |
| 4,179,771 | 12/1979 | Rankins et al. | 16/121 |
| 4,202,378 | 5/1980 | Bush et al. | 138/96 |
| 4,269,010 | 5/1981 | Glass | 52/298 |
| 4,575,978 | 3/1986 | Huhn et al. | 52/301 |
| 4,644,726 | 2/1987 | Wheeler | 52/67 |
| 4,655,023 | 4/1987 | Yung | 52/689 |
| 4,694,863 | 9/1987 | Klopp | 138/96 |
| 4,824,136 | 4/1989 | Bobby . | |
| 4,833,850 | 5/1989 | Lunn | 52/301 |
| 4,939,830 | 7/1990 | Janian | 29/173 |
| 4,972,642 | 11/1990 | Strobl, Jr. | 52/298 |
| 5,381,636 | 1/1995 | Kassardjian et al. | 52/301 |
| 5,447,290 | 9/1995 | Workman | 52/301 X |
| 5,523,043 | 6/1996 | Kassardjian et al. | 264/273 |
| 5,568,708 | 10/1996 | Kassardjian et al. | 52/301 |
| 5,613,336 | 3/1997 | Workman | 52/301 |

FOREIGN PATENT DOCUMENTS

| | | |
|---|---|---|
| 1157436 | 10/1960 | Germany . |
| 1810356 | 11/1968 | Germany . |
| 2534928 | 8/1975 | Germany . |
| 4036919 | 11/1990 | Germany . |
| 91 14839 | 10/1991 | WIPO . |

OTHER PUBLICATIONS

Don De Cristo Concrete Accessories, Inc. Catalog, "Plastic Rebar Guard", p. 43.

Deslauriers, Inc. brochure, "Delauriers Impalement–Protection Safety Cap Disc System".

*Primary Examiner*—Carl D. Friedman
*Assistant Examiner*—Yvonne Horton-Richardson
*Attorney, Agent, or Firm*—Fitzpatrick, Cella, Harper & Scinto

[57] ABSTRACT

A protective cover for covering an end of a concrete reinforcing bar so as to prevent injuries caused by coming into contact with the end of the concrete reinforcing bar, the protective cover including an elongated cylindrical collar for securing the protective cover to an exposed end of a concrete reinforcing bar, a cap which is arranged perpendicularly to the elongated cylindrical collar, and a bowl-shaped seat which is disposed between the elongated cylindrical collar and the cap and which is positioned such that a convex side of the bowl-shaped seat is directed toward the cap.

27 Claims, 3 Drawing Sheets

PROTECTIVE COVER FOR CONCRETE REINFORCING BAR

BACKGROUND OF THE INVENTION

1. Field of the Invention

The present invention relates to a protective cover for covering the end of a rod, and more particularly, to a protective cover used during construction for placement over the projecting end of a steel reinforcing bar.

2. Description of the Related Art

Typically, concrete structures, such as office buildings or highway overpasses, include steel reinforcing bars, oriented in both horizontal and vertical directions, which are placed within concrete forms prior to pouring the concrete. During construction, these steel reinforcing bars pose a safety hazard. For example, workers at grade level might be stabbed or gouged by the exposed ends of the reinforcing bars. Even worse, workers above grade, such as workers on scaffolding, might fall and become impaled on top of vertically-rising reinforcing bars.

In an attempt to reduce injury to workers, conventional bar guards, such as the type disclosed in U.S. Pat. No. 4,202,378, have been used to protect workers from being scraped or stabbed by the projecting ends of reinforcing bars at grade level. Although adequate for protecting against such scrapes and stabs, those conventional bar guards were not designed to, and do not, protect against the substantially greater forces involved when a worker falls onto vertically-rising reinforcement bars.

Realizing the dangers presented by exposed ends of reinforcing bars at construction sites, and recognizing that conventional bar guards do not prevent a worker from being impaled, divisions of the Occupational Safety and Health Standards Board (OSHA) have enacted safety standards requiring the use of protective covers for covering the exposed ends of reinforcing steel bars, so as to further protect against injury and impalement. The standards are intended to protect workers, working at grade or above grade, who are exposed to reinforcing steel or other projections, against the hazard of impalement by requiring that the exposed end of each reinforcing bar be covered with a protective cover.

The OSHA standard requires that: the surface of the protective cover shall be no smaller than a 4"×4" square; the protective cover shall be made of wood, plastic, or any similar material; and the protective cover shall be capable of withstanding, at a minimum, the impact of a 250-pound weight dropped from a height of 10 feet without penetration failure of the cover. This OSHA standard for protective covers is believed to provide substantial protection for workers at grade and above grade on construction sites.

In order to meet OSHA requirements and address the need for a protective cover which would not only prevent gouging and scraping but also impalement, the assignee of the present invention invented one type of protective cover, as disclosed in U.S. Pat. No. 5,381,636, which complies with the OSHA standards.

SUMMARY OF THE INVENTION

The present invention provides an improved protective cover which in one embodiment is adapted to cover an exposed end of a concrete reinforcing bar or other projection, and in another embodiment is adapted to be removably combined with a conventional bar guard.

According to one embodiment of the invention, the improved protective cover comprises an elongated cylindrical collar for securing the protective cover to the exposed end of the concrete reinforcing bar, a cap which is arranged perpendicularly to the elongated cylindrical collar, and a bowl-shaped seat which is disposed between the elongated cylindrical collar and the cap and which is positioned such that a convex side of the bowl-shaped seat is directed toward the cap. In this embodiment, the elongated cylindrical collar, the bowl-shaped seat and the cap are integrally formed into a single unitary member.

According to another embodiment of the invention, the improved protective cover is detachably assembled and comprises a bar guard portion comprising a collar section integrally formed with a top portion at one end and dimensioned to receive within the collar the concrete reinforcing bar at the other end; a cover portion having a bar guard receptacle for detachably receiving the top portion of the bar guard portion and a cap which is arranged perpendicularly to said bar guard receptacle; and a bowl-shaped seat which is adapted to be placed between the bar guard portion and the cover portion and which when positioned therebetween is oriented such that a concave side of the bowl-shaped seat is directed toward the bar guard portion when the bar guard portion is detachably received in the cover portion.

According to still another embodiment of the invention, the improved protective cover is for attaching to a conventional concrete reinforcing bar guard, said conventional bar guard having a collar which includes inwardly extending fins for grasping a reinforcing bar and a mushroom-shaped top perpendicularly attached to said collar. The protective cover according to this embodiment comprises a collar-shaped receptacle having inwardly extending means for detachably securing to the mushroom-shaped top of the conventional bar guard, a cap which is perpendicularly attached to the collar-shaped receptacle, and a bowl-shaped seat disposed within the collar-shaped receptacle. In this embodiment, a convex side of the seat is directed toward the cap, and when the conventional bar guard is fixedly secured to the collar-shaped receptacle, a concave side of the seat is directed toward the mushroom-shaped top.

The protective cover of the present invention not only provides workers with protection from being stabbed or gouged by an exposed end of a reinforcing bar, but also provides improved protection from impalement on a reinforcing bar. Specifically, because the protective cover includes a metal seat, the impact of a worker falling on the protective cover will not cause a penetration failure of the cover.

DETAILED DESCRIPTION OF THE PREFERRED EMBODIMENTS

The protective cover of the present invention is believed to meet current OSHA standards relating to protective covers for reinforcing bars.

Figure 1:
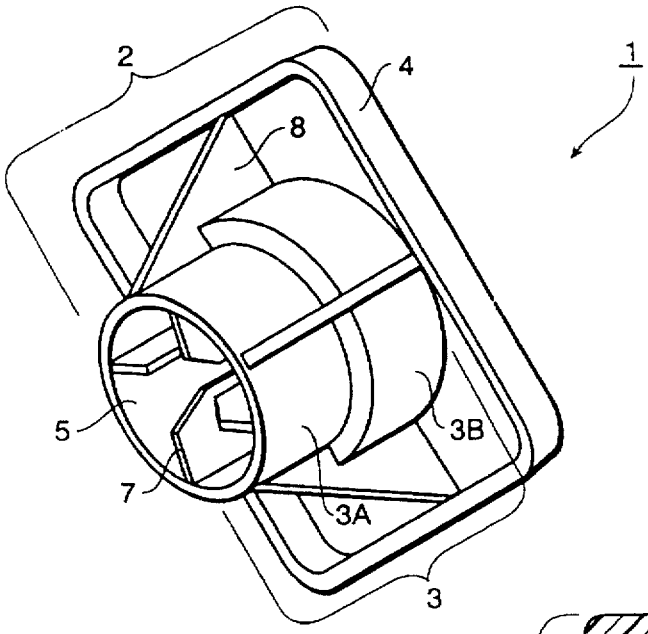
FIG. 1 is a bottom perspective view of the protective cover according to the first embodiment of the present invention.

The first embodiment of the present invention will now be discussed. FIG. 1 is a bottom perspective view of protective cover 1 according to the first embodiment of the invention. Protective cover 1 includes an integrally formed cap-and-collar assembly 2. Cap-and-collar assembly 2 includes a stepped collar section 3 and cap section 4.

As shown in FIG. 1, collar section 3 has a small outer diameter collar 3A which is integrally formed at one end with a large outer diameter collar 3B. Collar 3A has an open end 5 for receiving the reinforcing bar. Collar 3B has the same inner diameter as collar 3A, but a larger outer diameter, for a purpose which will become apparent below.

Inside collar section 3, there are inwardly extending and off-center fins 7 which secure the reinforcing bar to the protective cover 1. Fins 7 flex outwardly so as to accommodate reinforcing bars of varying sizes.

Also shown in FIG. 1 are four radially-extending reinforcing ribs 8 which extend from cap section 4 to a portion of collar section 3. In addition, reinforcing ribs 8 provide connectivity between collar section 3 and cap section 4, and also provide rigidity and structural integrity for cap-and-collar assembly 2. The purpose and effect of reinforcing ribs 8 are to prevent collar section 3 from separating from cap section 4 when a load is dropped or placed against cap section 4, for example, a load equivalent to the impact of a person striking against the protective cover. Reinforcing ribs 8 are integrally formed with, and made from the same material used for, collar section 3 and cap section 4.

Cap-and-collar assembly 2 and reinforcing ribs 8 are preferably made out of a resiliently-deformable plastic material such as heavy-duty polyethylene plastic. The material used for cap and collar assembly 2 and reinforcing ribs 8 preferably should be brightly colored so that it can be readily seen when in use on a reinforcing bar.

Figure 2:
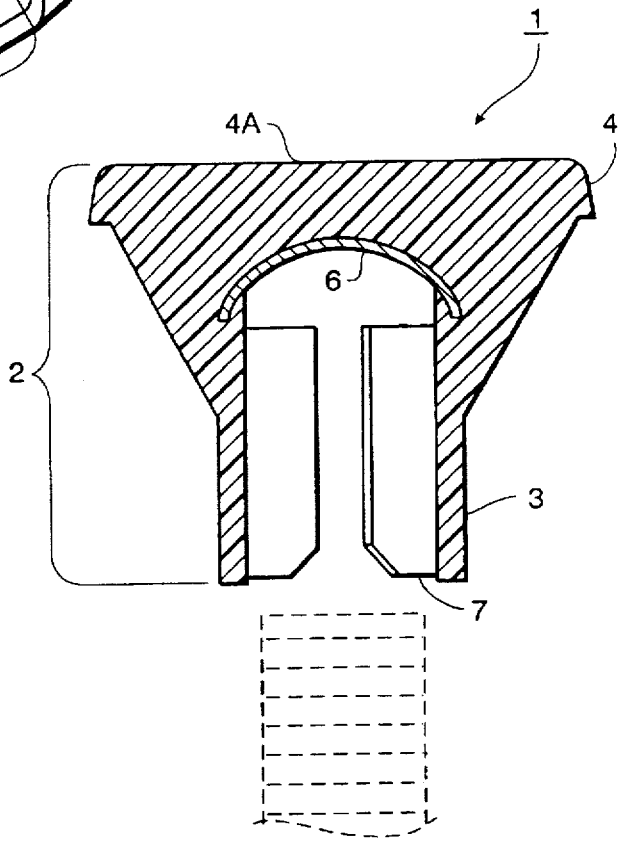
FIG. 2 depicts a longitudinal two-dimensional cross-section of the protective cover according to the first embodiment of the present invention.

FIG. 2 depicts a longitudinal two-dimensional cross-section of protective cover 1 according to the first embodiment of the invention. As shown in FIG. 2, bowl-shaped seat 6 is placed at the distal end of collar section 3 and integrally molded within collar 3B, leaving exposed only that portion of the surface of seat 6 which coincides with the inner diameter of collar 3B.

In a preferred embodiment, cap section 4 has a flat square top surface 4A with rounded edges. The dimensions of cap section 4 are designed to meet the OSHA standards for protective covers, and preferably, top surface 4A is 4"×4" square.

Figure 3:
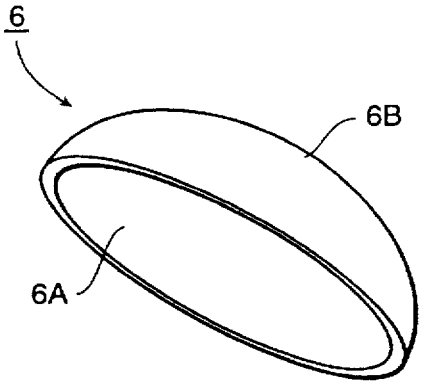
FIG. 3 is a side perspective view of the bowl-shaped seat.

FIG. 3 is a side perspective view of bowl-shaped seat 6. Seat 6 has concave side 6A and convex side 6B. As shown in FIG. 2, seat 6 is disposed between cap section 4 and collar section 3, such that concave side 6A is directed toward collar section 3 and convex side 6B is directed toward cap section 4. Seat 6 should be made from a rigid metal material and should have an appropriate thickness that would prevent penetration of the reinforcing bar through the cover when impacted with a 250 pound weight dropped from a height of 10 feet. Preferably, seat 6 is ⅛ inch thick and is manufactured from hot-rolled A36 steel.

As in U.S. Pat. No. 5,381,636, bowl-shaped seat 6 may also have slots so that reinforcing ribs 8 can pass from collar section 3 through seat 6 to cap section 4. In this manner, additional rigidity is provided to protective cover 1 and movement of metal seat 6 can be prevented.

In operation, when protective cap 1 is placed over a reinforcing bar, the reinforcing bar enters open end 5 of collar section 3. Collar section 3 receives the end of the reinforcing bar and the inwardly extending and off-center fins 7 spread apart so as to accommodate and to secure the bar to protective cover 1. Protective cover 1 is pressed firmly downward onto the bar until the bar is seated against bowl-shaped seat 6. Fins 7 detachably retain the reinforcing bar within protective cover 1 until such time as the protective cover has served its purpose. At such time, protective cover 1 can be removed from the reinforcing bar by pulling protective cover 1 in a direction away from the reinforcing bar, and if necessary, simultaneously twisting protective cover 1.

In the event that a worker comes in contact with protective cover 1 and the point of contact is directly on the center of protective cover 1, the load or force against protective cover 1 will be distributed through cap section 4 and bowl-shaped seat 6 directly to the reinforcing bar. On the other hand, if an off-center load or force impacts protective cover 1, the load will be distributed from cap section 4 to bowl-shaped seat 6 and reinforcing ribs 8 to collar section 3. Because bowl-shaped seat 6 wraps around the end of the reinforcing bar, penetration of the reinforcing bar should be prevented with respect to impacts occurring at a wide range of incident angles.

Generally, with respect to protective covers, upon impact the concrete reinforcing bar moves in a direction of least resistance relative to the cap portion of the protective cover. The effect of this in protective covers employing metal seats is that the reinforcing bar essentially attempts to find its way out from underneath the metal seat of the protective cover. However, in the present invention, bowl-shaped seat 6 prevents the reinforcing bar from finding its way out because the end of the bar is trapped within the concave side 6A of bowl-shaped seat 6. In this regard, protective covers presently in use, excluding the protective cover disclosed in U.S. Pat. No. 5,381,636 which utilizes a particular integrated structure to hold the metal seat in place, have been observed to exhibit penetration failures upon being impacted by a force equivalent to that of 250 pounds dropped from a height of ten feet because the reinforcing bar is able to move to an edge of the flat metal seat, thereby pushing aside the flat metal seat and permitting the reinforcing bar to penetrate the cap.

A simple example of an extended body impacting protective cover 1 at plural points, in rapid succession will illustrate the improved protection of the present invention. In the event that a left of center impact is followed by a right of center impact, a flat seat might be more likely to be jarred out of position following the first impact, allowing the reinforcing bar to immediately penetrate through the cap and leaving the reinforcing bar partially or wholly uncovered for the second impact. Bowl-shaped seat 6 of the present invention, however, is more limited in its potential range of movement, and would be more likely to remain in a sufficiently protective position following the first impact.

Thus, the foregoing design provides improved protection against penetration failure under a variety of circumstances when a falling body impacts the protective cap. Also, because bowl-shaped seat 6 wraps around the end of the reinforcing bar, the protective cap according to this invention should be more resistant to failure due to loads or forces tending to shear cap section 4 from collar section 3.

Figure 4:
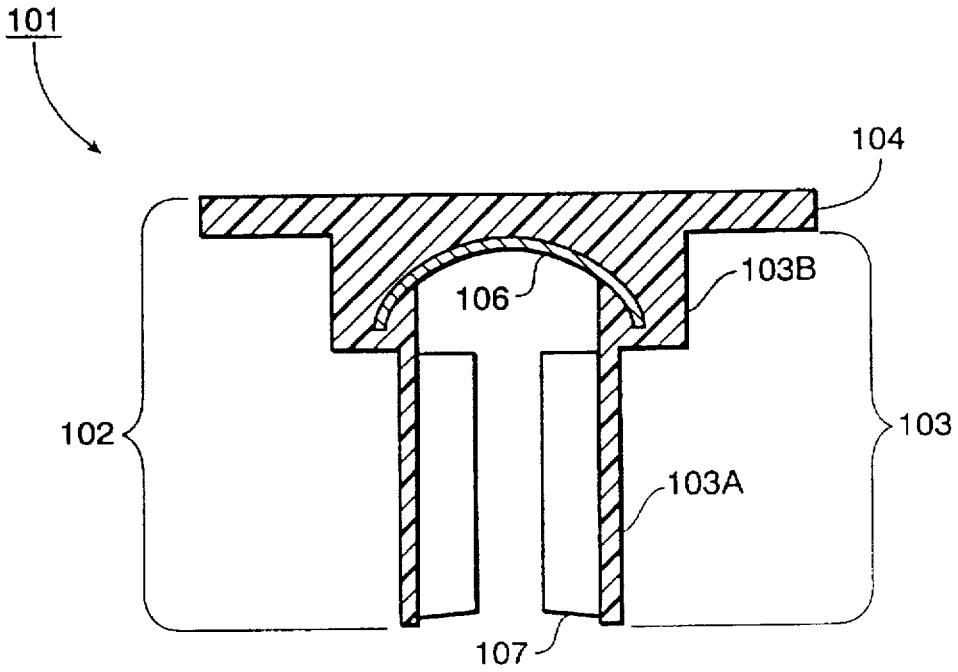
FIG. 4 depicts a longitudinal two-dimensional cross-section of the protective cover according to the second embodiment of the present invention.

The second embodiment of the present invention will now be discussed. FIG. 4 depicts a longitudinal two-dimensional cross-section of protective cover 101 according to the second embodiment of the present invention. As shown in FIG. 4, protective cover 101 has an integrally formed cap-and-collar assembly 102, including cap section 104 and collar section 103, which is injection-molded around bowl-shaped seat 106. Seat 106 is the same type as shown in FIG. 3.

Collar section 103 includes small outer diameter collar 103A and large outer diameter collar 103B. Both collar 103A and collar 103B have the same inner diameter. Similar to the first embodiment, collar section 103 has inwardly extending off-center fins 107 for grasping the reinforcing bar. Unlike the first embodiment, however, cap section 104 is attached to collar section 103 by collar 103B only. No reinforcing ribs are used. Otherwise, the second embodiment of the invention is physically and functionally identical to the first.

Figure 5:
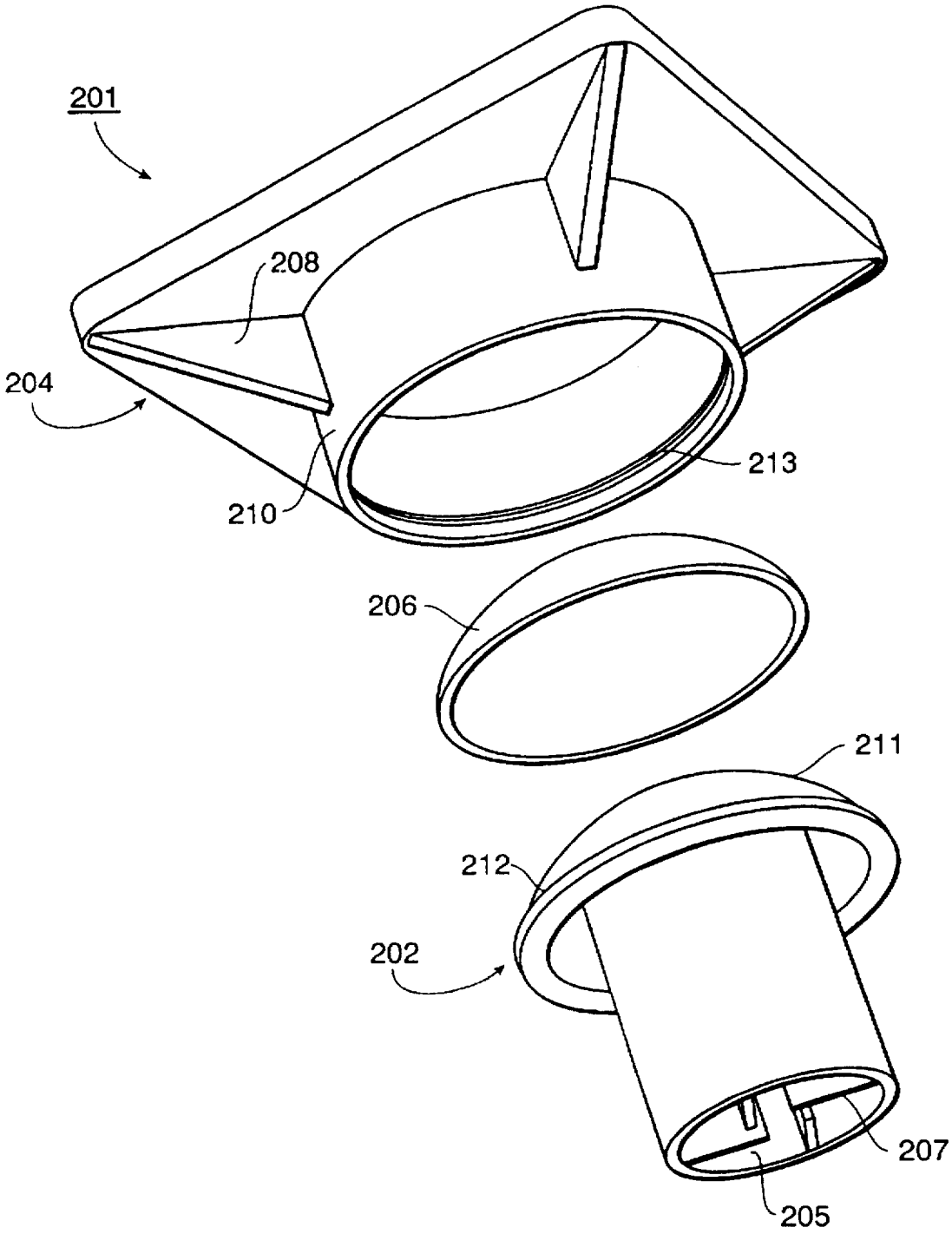
FIG. 5 is an exploded view of the protective cover according to the third embodiment of the invention.

The third embodiment of the present invention will now be discussed. This embodiment concerns a protective cover similar to the protective cover disclosed in the first embodiment, but rather than being integrally formed, several of its components are detachably assembled to form the protective cover. FIG. 5 is an exploded view of the third embodiment of the invention, showing protective cover 201 detached into its detachable component parts. As shown in FIG. 5, protective cover 201 has a bar guard portion 202 which includes integrally formed collar 203 and mushroom-shaped cap 211. Collar 203 has an open end 205 for receiving the reinforcing bar and fins 207 for grasping the reinforcing bar. Along the outer edge of mushroom-shaped cap 211 is lip 212.

Protective cover 201 also includes cover portion 204 and bowl-shaped seat 206 which is disposed between bar guard portion 202 and cover portion 204. Cover portion 204 includes an open-ended collar-shaped receptacle 210 which is slightly smaller in diameter than lip 212 and which receives the mushroom-shaped cap 211 of bar guard portion 202. The inner surface of collar-shaped receptacle 210 includes an inner groove 213 which is dimensioned to receive lip 212. Cover portion 204 also has four radially-extending reinforcing ribs 208, which provide additional structural rigidity, and a square flat top surface area, preferably having dimensions of 4"×4".

In use, seat 206 is removably inserted into collar-shaped receptacle 210 with the convex side of seat 206 directed toward cover portion 204. Mushroom-shaped cap 211 is then detachably inserted into collar-shaped receptacle 210 with the convex side of cap 211 directed toward the concave side of seat 206, as shown in FIG. 5. When so detachably inserted, lip 212 partially bends back until lip 212 encounters groove 213, at which point lip 212 inserts into groove 213, thereby detachably securing bar guard portion 202 to cover portion 204.

As discussed previously, bowl-shaped seat 206 is preferably ⅛ inch thick and manufactured from hot-rolled A36 steel, and each of the other components is preferably made out of a resiliently-deformable plastic material, such as heavy-duty polyethylene plastic.

Although the preferred embodiment of the invention employs mushroom-shaped cap 211 and groove 213 to detachably secure bar guard portion 202 to cover portion 204, it is to be understood that resiliently flexible lip 212 described above may be replaced by tabs or fingers or the like or any other conventional means for detachably securing two components, such as threading the two components or using screws, pins, clips or latches.

Once assembled, the third embodiment of the invention operates identically to the first embodiment discussed above.

Figure 6:
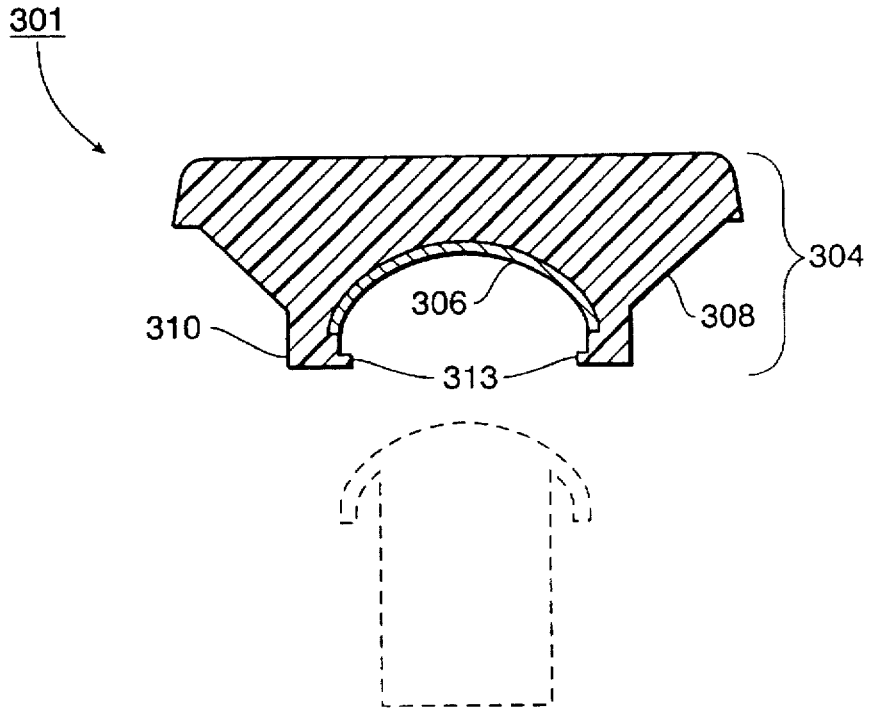
FIG. 6 depicts a longitudinal two-dimensional cross-section of the protective cover according to the fourth embodiment of the invention.

The fourth embodiment of the present invention will now be discussed. FIG. 6 depicts a longitudinal two-dimensional cross-section of the fourth embodiment of the invention. As shown in FIG. 6, protective cover 301 includes cap section 304 which is integrally formed around bowl-shaped seat 306.

Cap section 304 includes collar-shaped receptacle 310, which has an inner diameter large enough to permit insertion of a conventional mushroom-shaped bar guard, such as the type described in U.S. Pat. No. 4,202,378. Along the inner surface of collar-shaped receptacle 310 is inwardly extending fingers or lip 313 which permit protective cover 301 to be detachably secured to the conventional mushroom-shaped bar guard.

The inwardly extending fingers or lip shown in FIG. 6 are made from resiliently deformable material. For simplicity and brevity of description, the inwardly extending securing means shall be referred to as a lip, although inwardly projecting fingers may be used instead. In this regard, upon pushing protective cover 301 onto a conventional bar guard, lip 313 initially bends upward as the conventional bar guard is inserted, and then snaps back to again become perpendicular to collar-shaped receptacle 310 as the outer edge of the conventional bar guard passes lip 313. In this position, lip 313 supports the conventional bar guard from underneath the outer edge of its mushroom-shaped cap, thus detachably securing the conventional bar guard into cap section 304.

Four radially-extending reinforcing ribs 308 circle collar-shaped receptacle 310, connecting collar-shaped receptacle 310 to the rest of cap section 304, and providing rigidity and structural integrity for cap section 304.

Once again, it is preferable that seat 306 is ⅛ inch thick and is manufactured from hot-rolled A36 steel. Each of the other components is preferably made out of a resiliently-deformable plastic material, such as heavy-duty polyethylene plastic.

What is claimed is:

1. A protective cover for covering an end of a concrete reinforcing bar so as to prevent injuries caused by coming into contact with the end of the concrete reinforcing bar, said protective cover comprising:

an elongated cylindrical collar for securing the protective cover to the exposed end of the concrete reinforcing bar;

a cap which is arranged perpendicularly to the elongated cylindrical collar; and a bowl-shaped seat which is disposed between the elongated cylindrical collar and the cap and which is positioned such that a convex side of the bowl-shaped seat is directed toward the cap.

2. A protective cover according to claim 1, wherein the elongated cylindrical collar further comprises inwardly extending off-center fins for detachably securing said protective cover to the exposed end of the concrete reinforcing bar.

3. A protective cover according to claim 1, further comprising reinforcing ribs for connecting the elongated cylindrical collar to the cap.

4. A protective cover according to claim 3, wherein the bowl-shaped seat includes slots through which the reinforcing ribs pass.

5. A protective cover according to claim 1, wherein the bowl-shaped seat comprises a rigid metal material.

6. A detachably assembled protective cover for covering an end of a concrete reinforcing bar so as to prevent injuries caused by coming into contact with the end of the concrete reinforcing bar, said detachably assembled protective cover comprising:

a bar guard portion comprising a collar section integrally formed with a top portion at one end and dimensioned to receive within the collar the concrete reinforcing bar at the other end;

a cover portion having a bar guard receptacle for detachably receiving the top portion of the bar guard portion and a cap which is arranged perpendicularly to said bar guard receptacle; and a bowl-shaped seat which is adapted to be placed between the bar guard portion and the cover portion and which when positioned therebetween is oriented such that a concave side of the bowl-shaped seat is directed toward the bar guard portion when the bar guard portion is detachably received in the cover portion.

7. A detachably assembled protective cover according to claim 6, wherein the bar guard further comprises inwardly extending off-center fins for detachably securing said bar guard to the exposed end of the concrete reinforcing bar.

8. A detachably assembled protective cover according to claim 6, wherein said cover portion further comprises reinforcing ribs for connecting the bar guard receptacle to the cap.

9. A detachably assembled protective cover according to claim 8, wherein the bowl-shaped seat includes slots through which the reinforcing ribs pass.

10. A detachably assembled protective cover according to claim 6, wherein the bowl-shaped seat and the cover portion are integrally formed into a single unitary member.

11. A detachably assembled protective cover according to claim 6, wherein the bowl-shaped seat comprises a rigid metal material.

12. A detachably assembled protective cover according to claim 6, wherein the top portion of the bar guard comprises a mushroom-shaped cap having a lip around its outer edge, and wherein the bar guard receptacle is collar-shaped and comprises an inner groove adapted for receiving the lip of the mushroom-shaped cap.

13. A detachably assembled protective cover according to claim 6, wherein the top portion of the bar guard and the bar guard receptacle are each threaded, whereby the top portion of the bar guard can detachably screw into the bar guard receptacle.

14. A detachably assembled protective cover according to claim 6, wherein the top portion of the bar guard and the bar guard receptacle can be detachably secured to each other by at least one screw.

15. A detachably assembled protective cover according to claim 6, wherein the top portion of the bar guard and the bar guard receptacle can be detachably secured to each other by at least one pin.

16. A detachably assembled protective cover according to claim 6, wherein the top portion of the bar guard and the bar guard receptacle can be detachably secured to each other by at least one clip.

17. A detachably assembled protective cover according to claim 6, wherein the top portion of the bar guard and the bar guard receptacle can be detachably secured to each other by at least one latch.

18. A protective cover for attaching to a conventional bar guard, said conventional bar guard having a collar which includes inwardly extending fins for grasping a reinforcing bar and a mushroom-shaped top perpendicularly attached to said collar, said protective cover comprising:

a collar-shaped receptacle having inwardly extending means for detachably securing to the mushroom-shaped top of the conventional bar guard;

a cap which is perpendicularly attached to the collar-shaped receptacle; and a bowl-shaped seat disposed within the collar-shaped receptacle, wherein a convex side of the seat is directed toward the cap, and wherein when the conventional bar guard is fixedly secured to the collar-shaped receptacle a concave side of the seat is directed toward the mushroom-shaped top.

19. A protective cover according to claim 18, wherein the inwardly extending means comprises a lip made from a resiliently deformable material.

20. A protective cover according to claim 18, wherein the bowl-shaped seat and the cap are integrally formed into a single unitary member.

21. A protective cover according to claim 18, further comprising reinforcing ribs for connecting the collar-shaped receptacle to the cap.

22. A protective cover according to claim 21, wherein the bowl-shaped seat includes slots through which the reinforcing ribs pass.

23. A protective cover according to claim 18, wherein the bowl-shaped seat comprises a rigid metal material.

24. A protective cover according to any one of claims 1–5, wherein the elongated cylindrical collar, the bowl-shaped seat and the cap are integrally formed into a single unitary member.

25. A protective cover according to claim 1, wherein the bowl-shaped metal seat when positioned adjacent to an end of the concrete reinforcing bar is sufficiently strong to prevent penetration by the concrete reinforcing bar when impacted with a 250 pound weight dropped from a height of ten feet.

26. A protective cover for a concrete reinforcing bar comprising:

a collar-shaped receptacle having an open end;

a cap which is arranged perpendicularly to the collar-shaped receptacle; and a bowl-shaped seat disposed between the cap and the collar-shaped receptacle, wherein a convex side of the seat is directed toward the cap and a concave side of the seat is directed toward the collar-shaped receptacle.

27. A protective cover according to claim 26, wherein the bowl-shaped metal seat when positioned adjacent to an end of the concrete reinforcing bar is sufficiently strong to prevent penetration by the concrete reinforcing bar when impacted with a 250 pound weight dropped from a height of ten feet.

* * * * *